US005762507A

United States Patent [19]

Mochizuki et al.

[11] Patent Number: 5,762,507

[45] Date of Patent: Jun. 9, 1998

[54] CONNECTOR FOR WIRE AND FLAT CABLE AND METHOD OF MANUFACTURING THE SAME

[75] Inventors: Shinobu Mochizuki; Yoshiyuki Tanaka; Kouji Koike; Masataka Suzuki; Hiroyuki Ashiya, all of Shizuoka-ken, Japan

[73] Assignee: Yazaki Corporation, Tokyo, Japan

[21] Appl. No.: 689,114

[22] Filed: Jul. 30, 1996

[30] Foreign Application Priority Data

Jul. 31, 1995 [JP] Japan ..... 7-194724

[51] Int. Cl.[6] ..... H01R 35/04

[52] U.S. Cl. ..... 439/164; 439/15

[58] Field of Search ..... 439/164, 15, 492, 439/499, 606, 736; 29/868, 869, 872, 873

[56] References Cited

U.S. PATENT DOCUMENTS

| | | | |
|---|---|---|---|
| 5,059,134 | 10/1991 | Schauer et al. | 439/164 |
| 5,226,831 | 7/1993 | Horiuchi | 439/15 |
| 5,460,535 | 10/1995 | Bolen | 439/164 |
| 5,593,310 | 1/1997 | Kawamoto et al. | 439/164 |

FOREIGN PATENT DOCUMENTS

| | | |
|---|---|---|
| 4-24611 | 6/1992 | Japan . |
| 4-76257 | 7/1992 | Japan . |
| 5-62754 | 3/1993 | Japan . |
| 7-69219 | 3/1995 | Japan . |

*Primary Examiner*—Gary F. Paumen

*Attorney, Agent, or Firm*—Finnegan, Henderson, Farabow, Garrett & Dunner, L.L.P.

[57] ABSTRACT

In a connector for electric wires (5) and a flat cable (6) in which said electric wires (5) and said flat cable (6) which have exposed conductor portions (5A, 6A) formed at distal ends of said electric wires (5) and said flat cable (6) are held along a plate surface of an attaching plate (21). The exposed conductor portions (5A, 6A) are welded to each other. Insert molding is performed using a synthetic resin material (70) such that at least one portion of said attaching plate (21) and a welded portion between the exposed conductor portions (5A, 6A) are covered, a window portion (25) is formed in said attaching plate (21), and a plurality of bus bars (30) whose front and rear surfaces are exposed to said window portion (25) are arranged at a pitch corresponding to a conductor pitch of said flat cable (6). The exposed conductor portions (6A) of said flat cable (6) and the exposed conductor portions (5A) of said electric wires (5) are sequentially stacked on each other on one surface of each bus bar (30). Said bus bars (30) and both the exposed conductor portions (5A, 6A) are welded to each other in this state, and the insert molding is performed to the conductive-exposed portions (5A, 6A) and said bus bars (30).

10 Claims, 6 Drawing Sheets

CONNECTOR FOR WIRE AND FLAT CABLE AND METHOD OF MANUFACTURING THE SAME

BACKGROUND OF THE INVENTION

1. Field of the Invention

The present invention relates to a connector, for wires and a flat cable, used in an electric connection apparatus, and more particularly, to a connector connecting between a rotating member and a fixed member, for exchanging electric signals between the rotating member connected to a steering wheel in a steering mechanism and the fixed member connected to a steering column, and a method of manufacturing the connector.

2. Description of the Related Art

An electric connection apparatus disclosed in Japanese Unexamined Patent Publication 7-69219 is used as an electric connection apparatus.

In the connector for electric wires and a flat cable in the electric connection apparatus, the electric wires are pressed into a groove portion in one surface of an attaching plate to temporarily fix electric wires, the flat cable passes through a bridge on the other surface of the attaching plate to temporarily fix the flat cable, and the exposed conductor portions of the electric wires and flat cable protruding from the attaching plate in the same direction are ultrasonic-welded. A synthetic resin material is insert-molded around the attaching plate and the welded portion of the exposed conductor portions.

In the connector arranged as described above, the welded portion of the exposed conductor portions is protected by an insert molded synthetic resin material, and both the tensile strengths of the electric wires and the flat cable can be reinforced.

A similar technique related to a connector is disclosed in Japanese Unexamined Utility Model Publication No.4-76257 and Japanese Unexamined Patent Publication No.5-62754.

However, in a conventional connector for electric wires and a flat cable, a synthetic resin material is brought into direct contact with the exposed conductor portions of the flat cable during insert molding. At this time, depending on an injection pressure of an insert-molding machine and a flowing direction of the synthetic resin material, excessive stress may act on the exposed conductive portions. Since the conductor is thin and brittle, disconnection may occur. As a result, the reliability of the connector degrades.

More specifically, the conventional connector can be obtained such that the attaching plate and the welded portion of the exposed conductor portions are set in a cavity and insert-molded. The synthetic resin material flowing from a gate into a cavity in insert molding is roughly divided into a flow on the holding surface of a flat cable on the attaching plate and flow on the holding surface of electric wires on the attaching plate, filling in the cavity. At this time, a portion of the flowing synthetic resin material directly contacts the conductive-exposed portions of the flat cable, and excessive stress acts on the root portions which are non-supported portions of the exposed conductor portions. As a result, the exposed conductor portions may be disconnected from the root portions.

When the exposed conductor portions of the flat cable and the exposed conductor portions of the wires are welded to each other by ultrasonic welding, a honing head or an anvil serving as a welding jig is brought into direct contact with the exposed conductor portions of the flat cable. For this reason, stress acts on the thin and brittle exposed conductor portions of the flat cable, and welding may not be performed stably.

SUMMARY OF THE INVENTION

The present invention has been made to solve the above problem, and its object is to provide a connector, capable of stably obtaining a product having improved reliability, for electric wires and a flat cable, and a method of manufacturing the connection connector.

According to a first aspect of the present invention, a connector holds electric wires and a flat cable along a surface of an attaching plate. The electric wires and the flat cable have exposed conductor portions at distal ends of the electric wires and the flat cable. The exposed conductor portions are welded to each other. Insert molding is performed with a synthetic resin material such that at least one portion of the attaching plate and a welded portion between the exposed conductor portions is covered. The attaching plate has a window portion. A plurality of bus bars having front and rear surfaces exposed to the window portion are arranged at a pitch corresponding to a conductor pitch of the flat cable. The exposed conductor portions of the flat cable and the exposed conductor portions of the electric wires are sequentially stacked on each other on one surface of each bus bar. The bus bars and both of the exposed conductor portions are welded to each other in this state, and insert molding is performed around the exposed conductive portions and the bus bars.

In this connector, since the bus bars protect the exposed conductor portions of the flat cable, the exposed conductive portions of the flat cable are not peeled, and the flow of an insert-molding resin can be interrupted by the bus bars. Although the exposed conductor portions of the flat cable and electric wires are pressed on the bus bar side by the insert-molding resin flowing into the exposed conductor portions of the electric wires, the bus bars can receive the pressing force, and stress can be prevented from acting on the root of the welded portion of the flat cable. Since the bus bars are interposed between the exposed conductor portions, a honing head or anvil serving as a welding jig is not brought into direct contact with the exposed conductor portion of the flat cable. In addition, the bus bars can protect against externally transmitted heat because the bus bars are preset in the synthetic resin material such that the bus bars cover the exposed conductor portions of the flat cable.

According to a second aspect of the present invention, a connector for electric wires and a flat cable is characterized by an arrangement of the flat cable and the electric wires on one plate surface of the attaching plate such that the exposed conductor portions of the electric wires and the flat cable face in the same direction. The flat cable and the electric wires are held between the attaching plate and a cover detachably fitted on one plate surface of the attaching plate.

In this connector, the cover is fitted on the attaching plate, and the synthetic resin material is insert-molded, so that the flat cable and the electric wires can be reliably held.

According to the third aspect of the present invention, a connector for electric wires and a flat cable is characterized by a flat cable holding surface for linearly holding the flat cable on one plate surface of the attaching plate. An L-shaped electric wire storing member on a rear surface of the cover holds the distal ends of the electric wires parallel to the flat cable and holds the proximal ends of the electric wires in a direction perpendicular to the flat cable.

In this connector, the flat cable is set on the flat cable holding surface, and the electric wires are set in the electric wire storing member. When the cover is fitted on the attaching plate, the flat cable and the electric wires can be held reliably. In addition, the drawing directions of the flat cable and the electric wires can be kept perpendicular to each other.

According to the fourth aspect of the present invention, a connector for electric wires and a flat cable is characterized by the L-shaped electric wire storing member comprising a plurality of electric wire holding grooves. The distal ends of electric wires are fitted in the wire holding grooves to hold the distal ends of the electric wires at a pitch equal to a conductor pitch of the flat cable parallel to the flat cable. The connector is further characterized by a bent portion storing member for storing bent portions of all the electric wires bent in an L-shape from the distal end to the proximal end together.

In this connector, the distal ends of the electric wires are fitted in the electric wire holding grooves, and the bent portions are stored in the bent portion storing member, thereby holding the electric wires. Although the bent portions of all the electric wires are stored together with each other, the distal ends are held in the electric wire holding grooves, respectively. For this reason, the electric wires can be held smoothly, and the distal ends of the electric wires can be held at a pitch equal to the conductor pitch of the flat cable parallel to the flat cable. Because the connector has a bent portion storing member for holding the bent portions of the electric wires, the proximal ends of the electric wires can be drawn in a direction perpendicular to the flat cable.

According to the fifth aspect of the present invention, a connector for electric wires and a flat cable is characterized by a resin feeding through hole in a plate surface of the cover for guiding an externally filled insert-molding resin to the electric wire holding grooves.

In this connector, since the insert-molding resin is inserted from the resin feeding hole into the electric wire holding grooves, a gap around the wires and a gap around the flat cable can be reliably filled with the resin.

According to the sixth aspect of the present invention, a connector for electric wires and a flat cable is characterized by a resin feeding path formed in the cover for guiding the externally filled insert-molding resin to the bent portion storing member.

In this connector, since the insert-molding resin is inserted from the resin feeding path into the bent portion storing member of the wires, a gap around the wires and a gap around the flat cable can be filled reliably with the resin.

According to the seventh aspect of the present invention, a connector for electric wires and a flat cable is characterized by an electric wire drawing portion for guiding and holding the eletric wires extending in a direction perpendicular to the flat cable. The drawing portion is formed on the attaching plate. An electric wire pressing piece for pressing the electric wires between the electric wire drawing portion and the electric wire pressing piece is detachably fitted on the electric wire drawing portion.

In this connector, when the electric wire pressing piece is fitted on the electric wire drawing portion, the electric wires can be held reliably. The tensile strength of the electric wires can be improved.

According to the eighth aspect of the present invention, a connector for electric wire and a flat cable is characterized by an engagement pawl on the attaching plate for hooking a tab portion at the distal end of the flat cable.

In this connector, when the flat cable is set on the attaching plate, the flat cable is set such that the tab portion serving as a portion where an insulator left at the distal end of the flat cable is not removed is hooked on the engagement pawl. In this manner, the tab portion of the distal end is hooked, and soft and flexible exposed conductor portions can be kept straight along the bus bars. Therefore, the bus bars and the exposed conductor portions can be stably ultrasonic-welded.

According to the ninth aspect of the present invention, a connector for electric wires and a flat cable is characterized by a recessed portion for filling an insert-molding resin. The recessed portion is located on the attaching plate near the bus bars.

In this connector, since the recessed portion into which the insert-molding resin is filled is located near the bus bars, the portion around the bus bars, i.e., the welded portion of the exposed conductor portions are fixed reliably with the resin to be protected.

According to the tenth aspect of the present invention, a method of manufacturing a connector for electric wires and a flat cable is characterized by insert-molding the attaching plate having the bus bars, holding the electric wires and the flat cable having exposed conductor portions at distal ends of the electric wires and the flat cable along a plate surface of the attaching plate, sequentially stacking the exposed conductor portions of the flat cable and the exposed conductor portions of the electric wires on one surface of each bus bar, welding the bus bars and both the exposed conductor portions to each other in this state. Insert molding is performed such that the welded portion of the exposed conductor portions and a portion of the attaching plate are covered with a synthetic resin material.

According to this manufacturing method, since insert molding is performed such that both the exposed conductor portions of the electric wires and the flat cable are stacked on one surface of each bus bar, excessive stress acting on the exposed conductor portions during insert molding can be avoided independently of an injection pressure in the insert molding and the direction of the flow of the synthetic resin material into a cavity.

BRIEF DESCRIPTION OF THE DRAWINGS

in FIG. 2;

DETAILED DESCRIPTION OF THE PREFERRED EMBODIMENT

An embodiment of the present invention will be described below with reference to the accompanying drawings.

Figure 1:
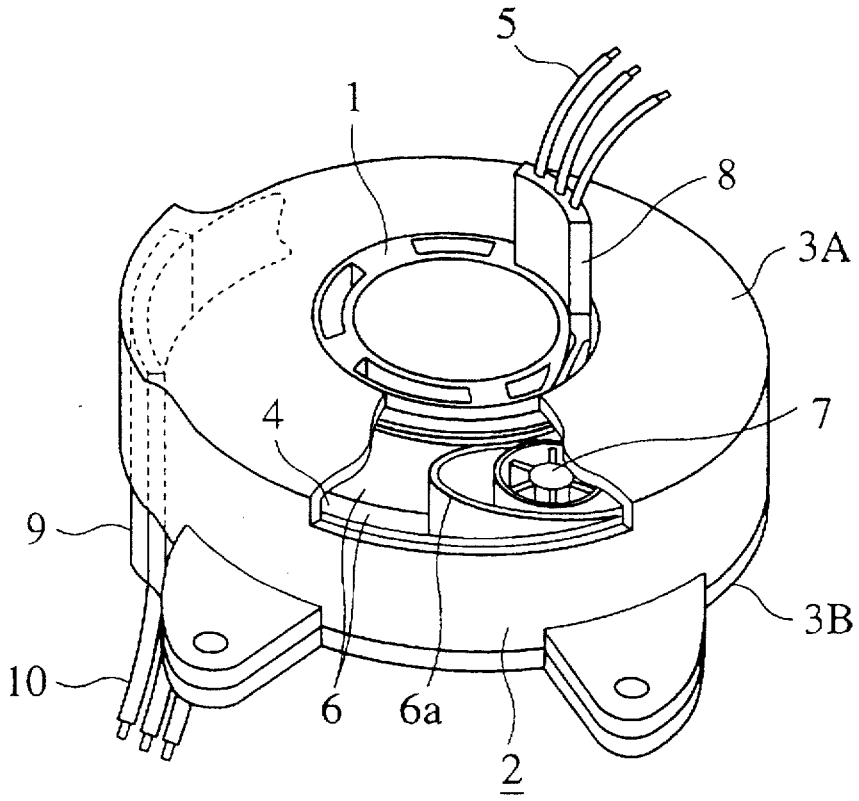
FIG. 1 is a perspective partial-cutaway view showing an electric connection apparatus to which a connector for electric wires and a flat cable is applied.
Figure 2:
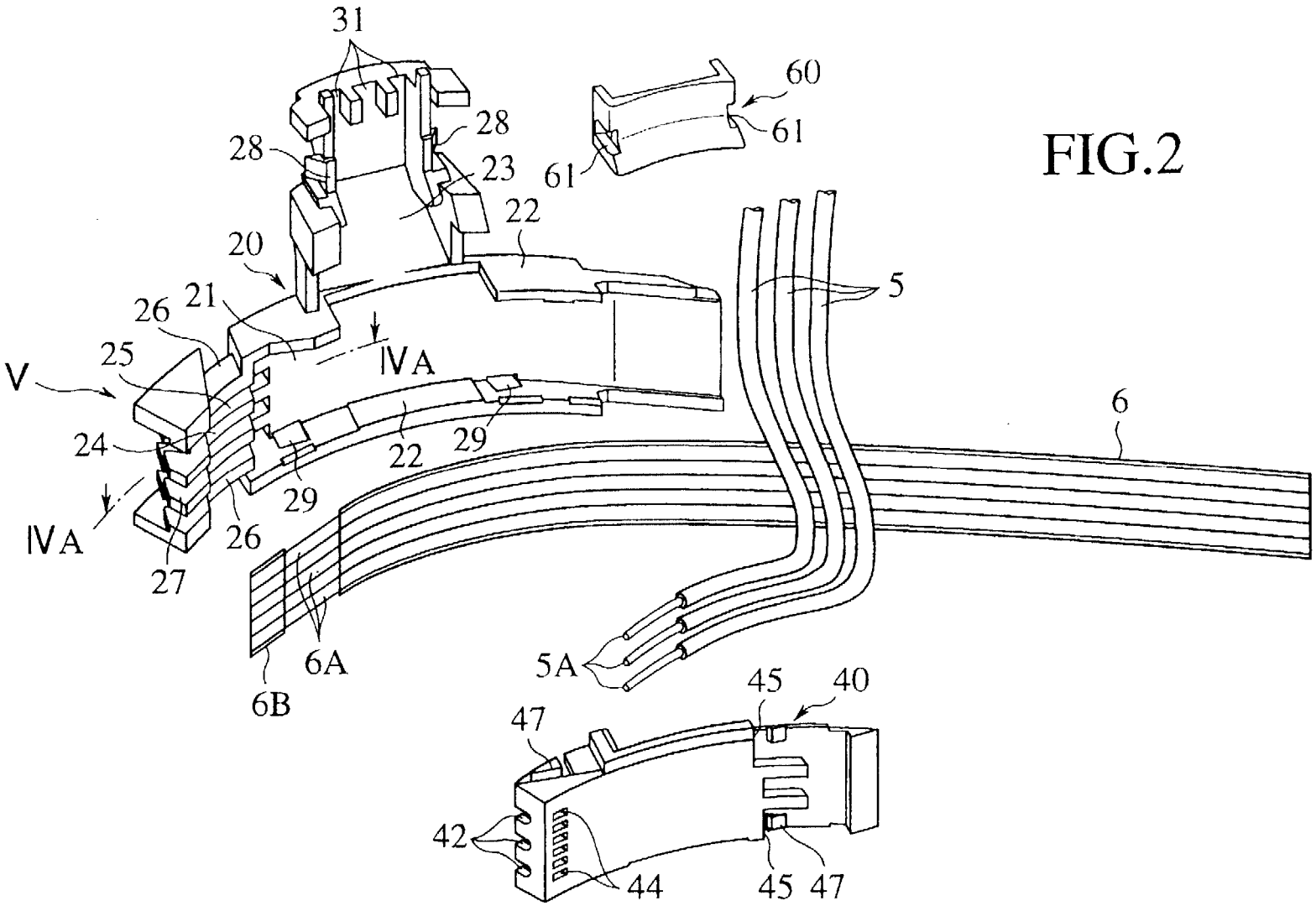
FIG. 2 is an exploded perspective view showing a framework of an embodiment of the present invention.
Figure 3:
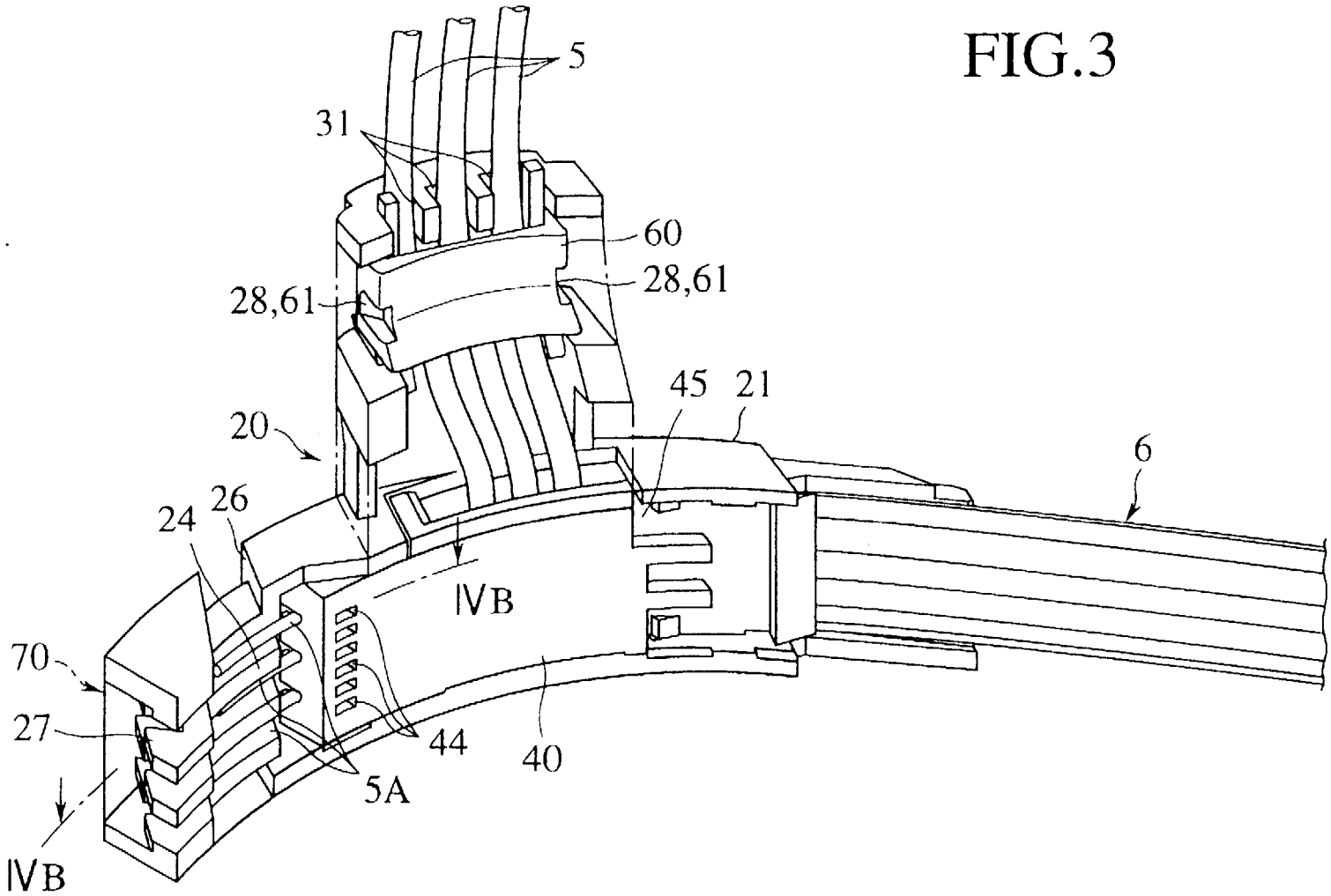
FIG. 3 is a perspective view showing an assembly state of the framework of the embodiment of the present invention.
Figure 4A:
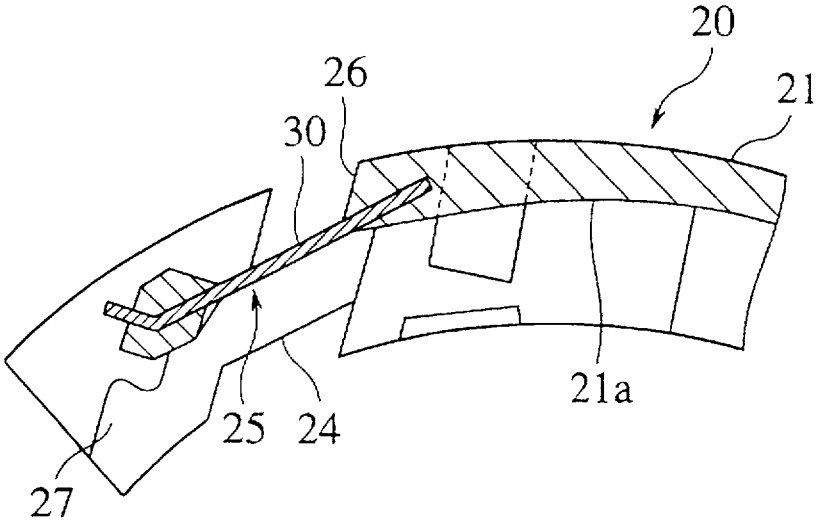
FIG. 4A is a sectional view showing the framework along a IVA—IVA in FIG.2.
Figure 4B:
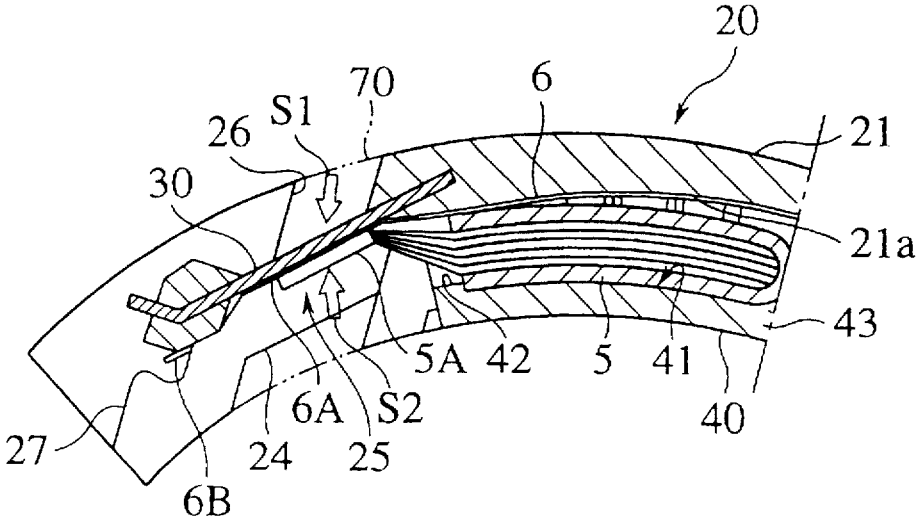
FIG. 4B is a sectional view showing the framework along a IVB—IVB.

FIG. 1 is a perspective partial-cutaway view showing an electric connection apparatus in which a connector for electric wires and a flat cable is used; FIG. 2 is an exploded perspective view showing the framework (state before insert molding is performed by a synthetic resin material) of the connector of an embodiment of the present invention; FIG. 3 is a perspective view showing an assembly state of the framework in FIG. 2; FIG. 4A is a sectional view showing the electric connection apparatus along a IVA—IVA line in FIG. 1; and FIG. 4B is a sectional view showing the electric connection apparatus along a IVB—IVB line in FIG. 3. Note that an alternate long and two short dashes line in FIGS. 3 and 4B indicates the profile of a resin-molded product formed by insert-molding the framework in FIG. 3. in the following description, it is assumed that the portion is an insert-molded resin 70.

An electric connection apparatus, as shown in FIG. 1, has a cylindrical rotating member 1 in which the shaft (not shown) of a steering wheel is inserted and an upper cover 3A and an under cover 3B constituting a housing 2 fixed to a steering column side (not shown) for rotatably supporting the rotating member 1. In an annular space 4 between the rotating member 1 and the housing 2, a flexible flat cable 6 folded in the annular space 4 and having both the ends fixed to the rotating member 1 and the housing 2, and a guide roller 7 are arranged.

The inner surface of the flat cable 6 is wound on the outer peripheral surface of the rotating member 1 using a reverse portion **6*a* as a boundary, and the outer surface is wound on the inner peripheral surface of the under cover 3B in a direction opposing the inner side. Connectors 8 and 9 arranged at both the ends of the flat cable 6 are fixed to the rotating member 1 and the housing 2** to be stored.

Both ends of the flat cable 6 are connected to electric wires 5 and 10 in the connectors 8 and 9, respectively. For example, the inner end of the flat cable 6 is connected to various switches (not shown) on the steering wheel side through the electric wires 5, and the external end is connected to a control circuit (not shown) on the steering column side through the electric wires 10.

The connectors 8 and 9 connect the electric wires 5 having exposed conductor portions 5A at their distal ends to the flat cable 6 having exposed conductor portions 6A with sufficient strength. The connectors 8 and 9 comprise a holder 20 serving as a main body, a cover 40 fitted in the holder 20, and an electric wire pressing piece 60 as constituent elements of the connector housing. All of these parts are composed of resin-molded products.

The holder 20 has an attaching plate 21 curved in the form of an arc and having a predetermined vertical width to arrange the holder 20 along the inner peripheral surface of the housing of the electric connection apparatus. Edge walls 22 extend inwardly along both ends of the attaching plate 21. The inner surface of the attaching plate 21 serves as a flat cable holding surface **21*a* for linearly holding the flat cable 6**.

The holder 20 has a flume-like electric wire drawing portion 23 extending from one side in the width direction of the attaching plate 21. The electric wire drawing portion 23 is arranged at the center of the attaching plate 21 in the longitudinal direction of the attaching plate 21. The edge wall 22 is notched at the position where the electric wire drawing portion 23 is arranged such that a portion between the flat cable holding surface **21*a* and the electric wire drawing portion 23** is a continuous recessed portion.

Figure 5:
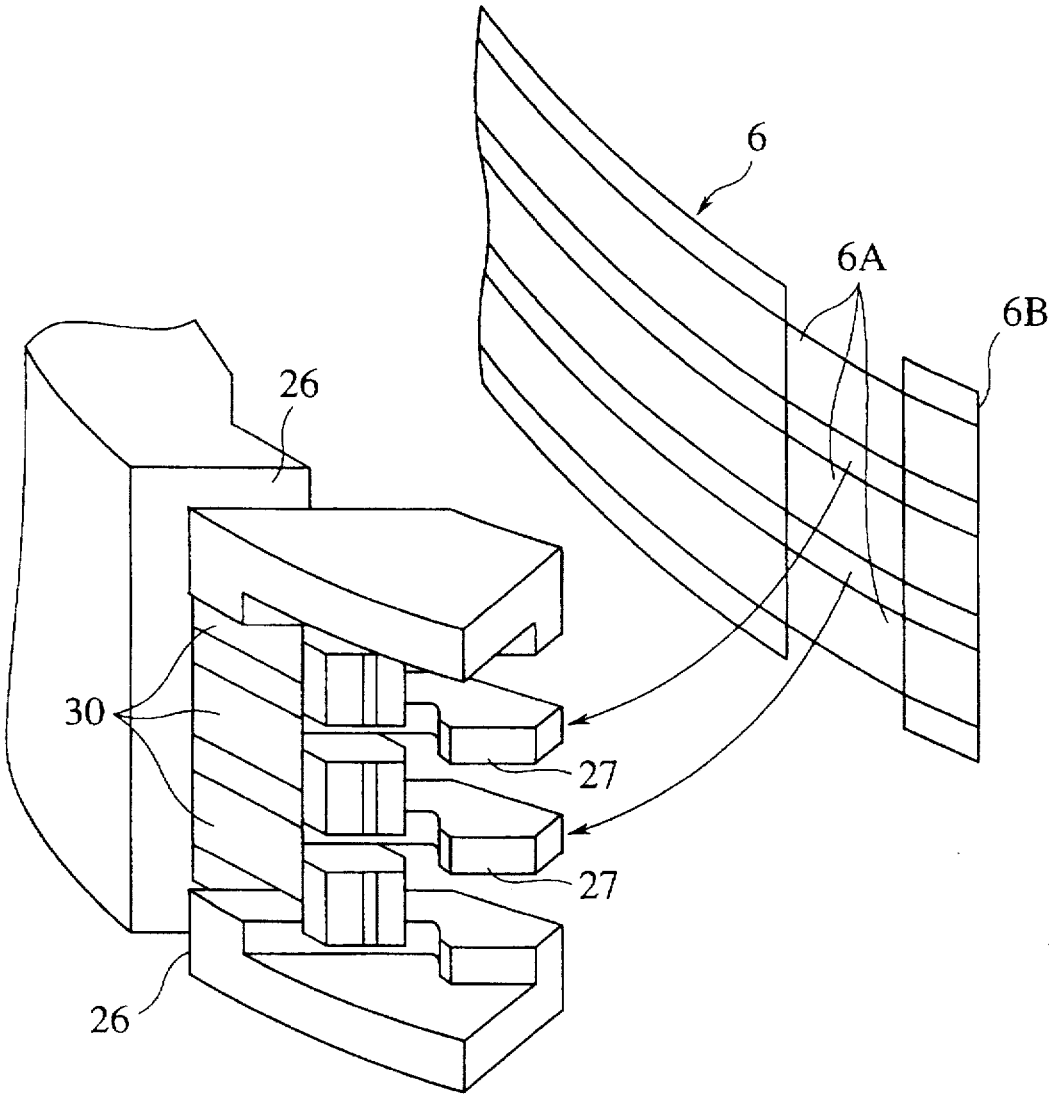
FIG. 5 is a back view of a V portion in FIG. 2.

A window portion 25 is arranged at one end of the attaching plate 21. The window portion 25 is divided by the number of connection electric wires (three, in this case) by partition walls 24 arranged parallel to the longitudinal direction of the attaching plate 21. As shown in FIGS. 4A, 4B, and 5, bus bars 30 constituted by copper plates (or other metal plates) and separated from each other are fitted in each window portion 25. The bus bars 30 are insert-molded in the holder 20. Three bus bars 30 are arranged in parallel along the longitudinal direction of the attaching plate 21 at a pitch equal to a conductor pitch of the flat cable 6. The front and rear surfaces of the bus bars 30 are exposed to the inner and outer peripheral surface sides of the attaching plate 21.

A portion of the edge wall 22 including the window portion 25 of the attaching plate 21 has a recessed portion 26 to improve the flow, filling characteristics, and connection characteristics of a resin when insert-molding is performed with a synthetic resin material. As shown in FIG. 4 in detail, an engagement pawl 27 extends from the distal end of the partition wall 24. Partition wall 24 partitions the window portion 25. The engagement pawl 27 is arranged to hook a tab portion 6B (non-removed portion of the insulator of the flat cable) at the distal end of the flat cable 6 as indicated by arrows in FIG. 5.

As shown in FIGS. 2 and 3, in the electric wire drawing portion 23, a lock portion 28 locked to an engagement portion 61 on the electric wire pressing piece 60 side when the electric wire pressing piece 60 is fitted in the electric wire drawing portion 23 adjacent to electric wire holding grooves 31. The edge wall 22 of the attaching plate 21 has a lock portion 29 locked to an engagement portion 47 on the cover 40 side when the cover 40 is fitted in the cover 40.

Figure 6:
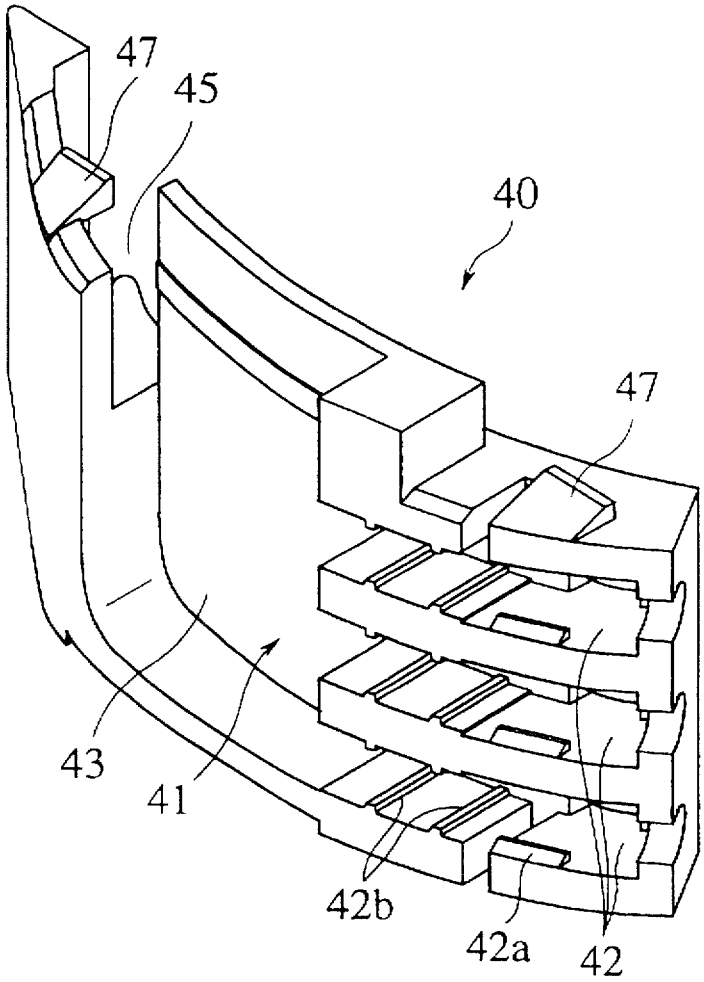
FIG. 6 is a back view of an inner cover in FIG. 2.

The cover 40, as shown in FIG. 6, is constituted by an arc-like plate along the attaching plate 21, and an L-shaped electric wire storing member 41 is arranged on a rear surface on the attaching plate 21 side. The L-shaped electric wire storing member 41 holds the electric wires 5 in a bent shape. Electric wire holding grooves 42 hold the distal end of each electric wire 5. A bent-portion storing member 43 holds L-shaped bent portions of all the electric wires 5 from the distal end side to the proximal end side. The bent-portion storing member 43 is designed to guide the proximal end sides of the electric wires 5 in a direction vertical to the flat cable 6, i.e., on the electric wire drawing portion 23 side.

The electric wire holding grooves 42 are arranged in parallel at a pitch equal to the conductor pitch of the flat cable 6 to hold the distal ends of the electric wires 5 in parallel at a pitch equal to the conductor pitch of the flat cable 6. Projections **42*a* and 42*b* are arranged in each electric wire holding groove 42 for holding the fitted electric wires 5 to prevent the electric wires from being removed are formed. The distal ends of the electric wire holding grooves 42 open the end wall of the cover 40**.

As shown in FIG. 3, externally filled resin feeding through holes 44 for feeding the insert-molded resin 70 are formed at the positions of the electric wire holding grooves 42 of the cover 40. in addition, a resin feeding path 45 for feeding the insert-molded resin 70 to the bent-portion storing member 43 is formed at the position of the end portion of the bent-portion storing member 43.

To manufacture the connector, the holder 20 having the bus bars 30, the cover 40, and the electric wire pressing piece 60 are provided. As shown in FIG. 2, the electric wires 5 and the flat cable 6 are provided, exposed conductive portions 5A are formed at the distal ends of the electric wires 5, and exposed conductor portions 6A are formed at the distal end of the flat cable 6. The tab portion 6B remains at the distal end of the flat cable 6 to prevent the exposed conductor portions 6A from being deformed. The flat cable 6 is set on the flat cable holding surface **21*a* of the holder 20 such that the tab portion 6B is hooked on the engagement pawls 27 at the distal end of the holder 20**.

The electric wires 5 are fitted in the electric wire holding grooves 42 on the rear surface of the cover 40, and the cover 40 is fitted in the holder 20 such that the bent portions of the electric wires 5 are stored in the bent-portion storing member 43. The cover 40 is fixed to the holder 20 by the engagement portion 47 and the lock portion 29 to prevent the cover 40 and the holder 20 from being removed from each other. The electric wires 5 and the flat cable 6 can be held reliably between the cover 40 and the attaching plate 21 while the exposed conductive portions 6A and 5A face in the same direction.

The distal exposed conductor portions 6A of the flat cable 6 and the distal exposed conductive portions 5A of the electric wires 5, as shown in FIGS. 4A and 4B, are positioned for stacking in this order on the surfaces of the bus bars 30 arranged in the window portion 25 of the holder 20. The flat cable 6 can be positioned easily with respect to the bus bars 30 by setting only the distal tab portion 6B to be hooked on the engagement pawls 27. The electric wires 5 can be positioned easily with respect to the bus bars 30 by fixing only the cover 40 to the holder 20 while the electric wires 5 are fitted in the electric wire holding grooves 42.

When the cover 40 is fitted in the holder 20, the proximal end side of the flat cable 6 is externally drawn from one end of the attaching plate 21, and the proximal end side of the electric wires 5 is drawn in a direction vertical to the flat cable 6 along the electric wire drawing portion 23. When the electric wire pressing piece 60 is fitted in the electric wire drawing portion 23, the proximal end side of the electric wires 5 can be pressed reliably.

The overlap portion of the bus bars 30, the exposed conductor portions 6A of the flat cable 6, and the conductive-exposed portions 5A of the electric wires 5 is interposed between the honing head and anvil of an ultrasonic welding machine. The three members are welded to each other by ultrasonic welding. In this welding process, since the bus bars 30 are interposed between the conductive-exposed portions 5A and the exposed conductor portions 6A, a welding jig is not brought into direct contact with the exposed conductor portions 6A of the flat cable 6. For this reason, stress acting on the exposed conductor portions 6A in the welding process can be reduced.

Upon completion of the welding process, an assembled body shown in FIG. 3 is assembled. The assembled body is inserted into a molding die and insert-molded with a synthetic resin. The window portion 25 including the welded portion of the bus bars 30 and the conductive-exposed portions 5A and 6A, the other recessed portion 26, and the like are filled with the insert-molded resin 70, thereby obtaining a connector according to this embodiment.

Because the plurality of conductive-exposed portions 5A and 6A are separated by the partition walls 24 arranged in the window portion 25, the conductive-exposed portions 5A and 6A corresponding to each other are accurately welded not to interfere with other adjacent exposed conductive portions 5A and 6A adjacent.

During insert molding, the exposed conductor portions 6A of the flat cable 6 are protected by the bus bars 30, and the exposed conductor portions 6A are not peeled. The flow of a resin indicated by an arrow S1 in FIG. 4B is interrupted, and excessive stress does not act on the exposed conductor portions 6A of the flat cable 6. The conductive-exposed portions 6A and 5A of the flat cable 6 and the electric wires 5 are pressed on the bus bar 30 sides by the flow of a resin toward the exposed conductive portions 5A of the electric wires as indicated by the arrow S1 in FIG. 4B. However, since the pressing force is received reliably by the bus bars 30, excessive stress does not act on the exposed conductor portions 6A of the flat cable 6. Therefore, disconnection of the electric wires or cable during a welding process or an insert-molding process can be prevented.

Because the insert-molded resin 70 is inserted through the resin feeding hole 44 or the resin feeding path 45 into the cover 40, a gap around the electric wires 5 and a gap around the flat cable 6 can be buried reliably with resin, and the the electric wires 5 and the flat cable 6 can be held more effectively.

In actual use, because the bus bars 30 are present in the synthetic resin while the bus bars 30 cover the exposed conductor portions 6A of the flat cable 6, externally transmitted heat can be blocked by the bus bars 30, and the exposed conductor portions 6A can be protected from thermal stress by using the connector.

What is claimed is:

1. A connector for electric wires and a flat cable, the electric wires and the flat cable being held along a plate surface of an attaching plate;

exposed conductor portions at distal ends of the electric wires and the flat cable, the exposed conductor portions of the electric wire being welded to the exposed conductor portion of the flat cable;

synthetic resin material covering at least one portion of the attaching plate and a welded portion between the exposed conductor portions;

the connector comprising:

a window portion in the attaching plate; and a plurality of bus bars having front and rear surfaces exposed to the window portion and arranged at a pitch corresponding to a conductor pitch of the flat cable;

the exposed conductor portions of the flat cable and the exposed conductor portions of the electric wires being sequentially stacked on each other on one surface of each bus bar, the bus bars and both exposed conductor portions being welded to each other, and the exposed conductive portions and the bus bars being insert molded.

2. A connector for electric wires and a flat cable according to claim 1, wherein the flat cable and the electric wires are arranged on one plate surface of the attaching plate such that the exposed conductor portions of the electric wires and the flat cable face in the same direction, and the flat cable and the electric wires are held between the attaching plate and a cover detachably fitted on one plate surface of the attaching plate.

3. A connector for electric wires and a flat cable according to claim 2, wherein a flat cable holding surface for linearly holding the flat cable is on one plate surface of the attaching plate, and an L-shaped electric wire storing member for holding the distal ends of the electric wires parallel to the flat cable and holding the proximal ends of the electric wires in a direction perpendicular to the flat cable is on the rear surface of the cover.

4. A connector for electric wires and a flat cable according to claim 3, wherein the L-shaped electric wire storing member comprises:

a plurality of electric wire holding grooves, the distal ends of electric wires are fitted in the electric wire holding grooves to hold the distal ends of the electric wires at a pitch equal to a conductor pitch of the flat cable parallel to the flat cable; and a bent portion storing member for storing bent portions of all the electric wires bent in an L-shape from the distal end to the proximal end together.

5. A connector for electric wires and a flat cable according to claim 4, wherein a plate surface of the cover has a resin feeding through hole for guiding an externally filled insert-molding resin to the electric wire holding grooves.

6. A connector for electric wires and a flat cable according to claim 4, wherein the cover has a resin feeding path for guiding the externally filled insert-molding resin to the bent portion storing member.

7. A connector for electric wires and a flat cable according to claim 3, wherein the attaching plate has an electric wire drawing portion for guiding and holding the electric wires extending in a direction perpendicular to the flat cable, and an electric wire pressing piece for pressing the electric wires between the electric wire drawing portion and the electric wire pressing piece is detachably fitted on the electric wire drawing portion.

8. A connector for electric wires and a flat cable according to claim 1, wherein the attaching plate has an engagement pawl for hooking a tab portion at the distal end of the flat cable.

9. A connector for electric wires and a flat cable according to claim 1, wherein a portion of the attaching plate around the bus bars has a recessed portion for filling an insert-molding resin.

10. A method of manufacturing a connector for electric wires and a flat cable, the method comprising the steps of:

insert-molding an attaching plate having bus bars;

holding the electric wires and the flat cable having exposed conductor portions at distal ends of the electric wires and the flat cable along a plate surface of the attaching plate;

sequentially stacking the exposed conductor portions of the flat cable and the exposed conductor portions of the electric wires on one surface of each of each bus bar;

welding the bus bars and both the exposed conductor portions to each other; and insert-molding and covering the bus bar, the welded portion of the exposed conductor portions, and a portion of the attaching plate with a synthetic resin material.

* * * * *